US010443483B2

(12) United States Patent
Scavone et al.

(10) Patent No.: US 10,443,483 B2
(45) Date of Patent: Oct. 15, 2019

(54) COMBINING ENGINE HEAD AND ENGINE BLOCK FLOW REQUESTS TO CONTROL COOLANT FLUID FLOW IN A VEHICLE COOLING SYSTEM FOR AN INTERNAL COMBUSTION ENGINE

(71) Applicant: GM Global Technology Operations LLC, Detroit, MI (US)

(72) Inventors: Luca Scavone, Moncalieri (IT); Felix Mauricio Quinones Davila, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 137 days.

(21) Appl. No.: 15/659,797

(22) Filed: Jul. 26, 2017

(65) Prior Publication Data

US 2019/0032542 A1 Jan. 31, 2019

(51) Int. Cl.

| | |
|---|---|
| ***F01P 7/16*** | (2006.01) |
| ***F01P 3/12*** | (2006.01) |
| ***F01P 3/02*** | (2006.01) |
| ***F01P 7/14*** | (2006.01) |
| *F01P 3/18* | (2006.01) |

(52) U.S. Cl.

CPC ..... *F01P 7/165* (2013.01); *F01P 3/02* (2013.01); *F01P 3/12* (2013.01); *F01P 3/18* (2013.01); *F01P 2003/021* (2013.01); *F01P 2003/024* (2013.01); *F01P 2003/027* (2013.01); *F01P 2007/146* (2013.01); *F01P 2023/08* (2013.01)

(58) Field of Classification Search

CPC ... B60H 1/04; B60H 1/06; B60H 1/08; B60H 1/00885; F01P 3/20; F01P 7/14; F01P 7/16; F01P 7/165; F01P 7/167; F01P 11/08; F01P 11/16; F01P 2007/146; F01P 2007/168; F01P 2037/00; F01P 2060/045; F16H 57/0413; F02M 26/25; F02M 26/28; F02M 26/30; F02B 29/0443; F02B 29/0406; F01M 5/005; F01M 5/007; F02N 11/0829

USPC ..... 123/41.05, 41.06, 41.07, 41.08, 41.09, 123/41.1, 41.33, 41.31, 41.44, 41.02; 180/339; 236/34.5; 165/43

See application file for complete search history.

(56) References Cited

U.S. PATENT DOCUMENTS 6,098,576 A * 8/2000 Nowak, Jr. ..... F01P 3/20 123/41.29
8,695,541 B2 * 4/2014 Nishikawa ..... F01P 3/02 123/41.08

(Continued)

*Primary Examiner* — Jacob M Amick
*Assistant Examiner* — Michael A Kessler
(74) *Attorney, Agent, or Firm* — Cantor Colburn LLP

(57) ABSTRACT

Examples of techniques combining flow requests to control coolant fluid in a cooling system for an internal combustion engine are provided. In one example implementation, a method includes receiving, by a processing device, a block flow request from an engine block. The method further includes receiving, by the processing device, a head flow request from an engine head. The method further includes calculating, by the processing device, an engine flow based at least in part on the block flow request and the head flow request. The method further includes calculating, by the processing device, a flow split request based at least in part on the block flow request and the engine flow. The method further includes operating, by the processing device, a block rotary valve based at least in part on the block flow.

15 Claims, 5 Drawing Sheets

(56) References Cited

U.S. PATENT DOCUMENTS

| | | | | |
|---|---|---|---|---|
| 8,978,596 | B2 * | 3/2015 | Glassford | F01P 3/20 123/41.05 |
| 9,470,138 | B2 * | 10/2016 | Miyagawa | F01P 7/16 |
| 10,180,101 | B1 * | 1/2019 | Park | F01P 11/16 |
| 10,190,478 | B1 * | 1/2019 | Giraudo | F01P 7/16 |
| 2013/0160723 | A1 * | 6/2013 | Miyagawa | F01P 7/16 123/41.1 |
| 2016/0123218 | A1 * | 5/2016 | Lee | F01P 7/165 123/41.08 |
| 2016/0146092 | A1 * | 5/2016 | Lee | F01P 7/16 123/41.1 |
| 2016/0201548 | A1 * | 7/2016 | Moscherosch | F01P 7/162 123/41.02 |
| 2016/0215680 | A1 * | 7/2016 | Quix | F01P 3/02 |
| 2017/0138248 | A1 * | 5/2017 | Lee | F01P 7/16 |

* cited by examiner

COMBINING ENGINE HEAD AND ENGINE BLOCK FLOW REQUESTS TO CONTROL COOLANT FLUID FLOW IN A VEHICLE COOLING SYSTEM FOR AN INTERNAL COMBUSTION ENGINE

The present disclosure relates generally to internal combustion engines and more particularly to combining engine head and engine block flow requests to control coolant flow in a vehicle cooling system for an internal combustion engine.

A vehicle, such a car, motorcycle, or any other type of automobile may be equipped with an internal combustion engine to provide a source of power for the vehicle. Power from the engine can include mechanical power (to enable the vehicle to move) and electrical power (to enable electronic systems, pumps, etc. within the vehicle to operate). As an internal combustion engine operates, the engine and its associated components generate heat, which can damage the engine and its associated components if unmanaged.

To reduce heat in the engine, a cooling system circulates a coolant fluid through cooling passages within the engine. The coolant fluid absorbs heat from the engine and is then cooled via heat exchange in a radiator. Accordingly, the coolant fluid becomes cooler and is then circulated back through the engine to cool the engine and its associated components.

SUMMARY

Examples of techniques for combining flow requests to control coolant fluid in a cooling system for an internal combustion engine are provided. In one example embodiment, a computer-implemented method includes receiving, by a processing device, a block flow request from an engine block. The method further includes receiving, by the processing device, a head flow request from an engine head. The method further includes calculating, by the processing device, an engine flow based at least in part on the block flow request and the head flow request. The method further includes calculating, by the processing device, a flow split request based at least in part on the block flow request and the engine flow. The method further includes operating, by the processing device, a block rotary valve based at least in part on the flow split request.

In another example embodiment, a system for combining flow requests to control coolant fluid in a cooling system for an internal combustion engine is provided. The system includes a memory comprising computer readable instructions and a processing device for executing the computer readable instructions for performing a method. The method includes receiving, by a processing device, a block flow request from an engine block. The method further includes receiving, by the processing device, a head flow request from an engine head. The method further includes calculating, by the processing device, an engine flow based at least in part on the block flow request and the head flow request. The method further includes calculating, by the processing device, a flow split request based at least in part on the block flow request and the engine flow. The method further includes operating, by the processing device, a block rotary valve based at least in part on the flow split request.

In another example embodiment, a computer program product for combining flow requests to control coolant fluid in a cooling system for an internal combustion engine is provided. The computer program product includes a computer readable storage medium having program instructions embodied therewith, wherein the computer readable storage medium is not a transitory signal per se, the program instructions executable by a processing device to cause the processing device to perform a method. The method includes receiving, by a processing device, a block flow request from an engine block. The method further includes receiving, by the processing device, a head flow request from an engine head. The method further includes calculating, by the processing device, an engine flow based at least in part on the block flow request and the head flow request. The method further includes calculating, by the processing device, a flow split request based at least in part on the block flow request and the engine flow. The method further includes operating, by the processing device, a block rotary valve based at least in part on the flow split request.

According to one or more embodiments, calculating the engine flow comprises summing the block flow request and the head flow request. According to one or more embodiments, calculating the flow split request comprises dividing the block flow request by the engine flow. According to one or more embodiments, operating the block rotary valve comprises one of opening the block rotary valve or closing the block rotary valve. According to one or more embodiments, operating the block rotary valve enables the coolant fluid to flow through the engine head and the engine block based on the engine flow and the flow split request. According to one or more embodiments, an inlet of the block rotary valve is in fluid communication with an outlet of an engine block and a first inlet of a flow control valve, and wherein an outlet of the engine head is in fluid communication with a second inlet of the flow control valve. According to one or more embodiments, an outlet of the flow control valve is in fluid communication with an inlet of a main rotary valve.

The above features and advantages, and other features and advantages of the disclosure, are readily apparent from the following detailed description when taken in connection with the accompanying drawings.

BRIEF DESCRIPTION OF THE DRAWINGS

Other features, advantages, and details appear, by way of example only, in the following detailed description, the detailed description referring to the drawings in which.

DETAILED DESCRIPTION

Figure 1:
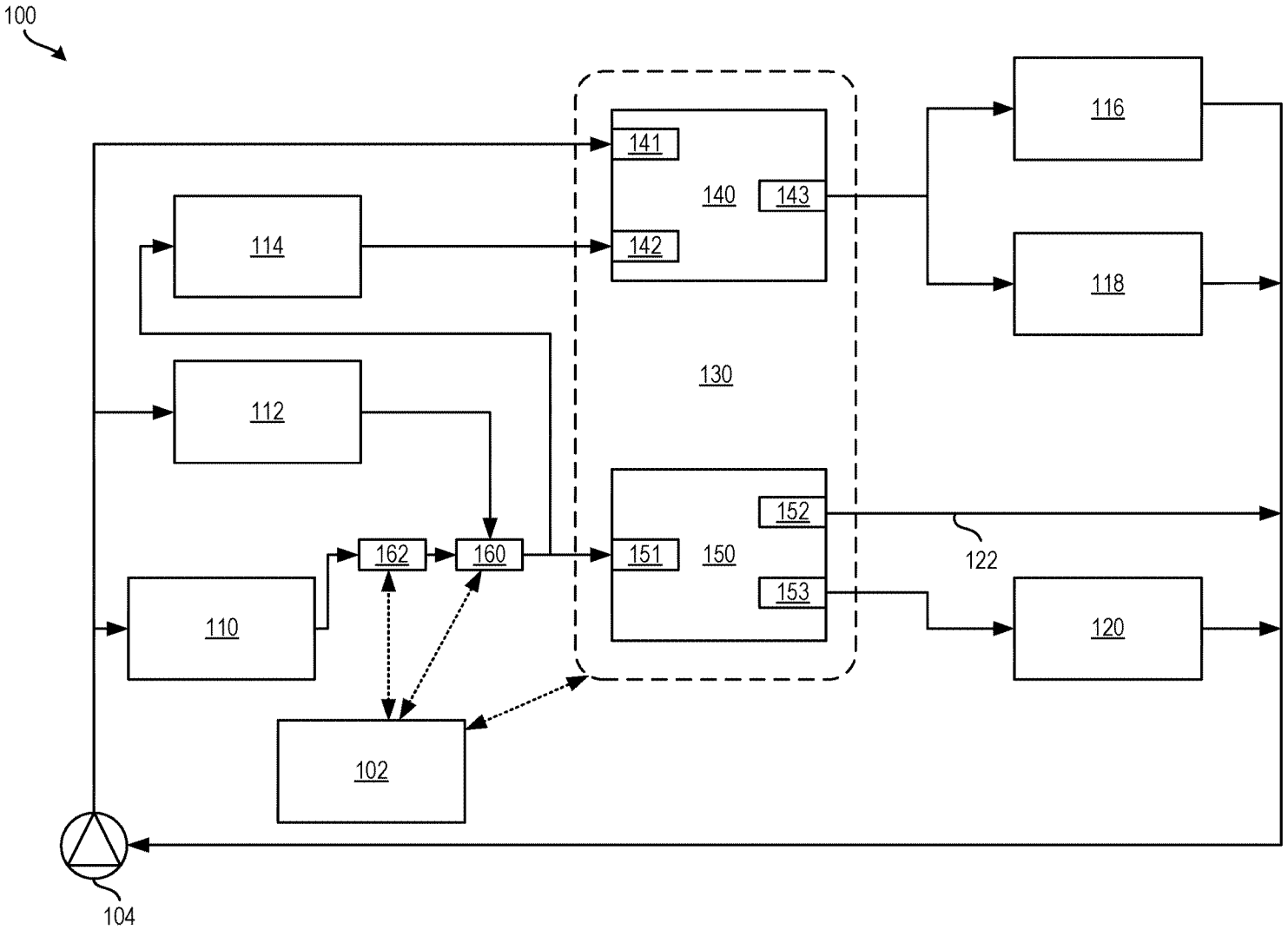
FIG. 1 depicts a vehicle engine including a flow control valve and a block rotary valve that can be adjusted for combining engine head and engine block flow requests to control coolant fluid in the vehicle engine, according to embodiments of the present disclosure.

The following description is merely exemplary in nature and is not intended to limit the present disclosure, its application or uses. It should be understood that throughout the drawings, corresponding reference numerals indicate like or corresponding parts and features. As used herein, the term module refers to processing circuitry that may include an application specific integrated circuit (ASIC), an electronic circuit, a processor (shared, dedicated, or group) and memory that executes one or more software or firmware programs, a combinational logic circuit, and/or other suitable components that provide the described functionality.

The technical solutions described herein provide for combining engine head and engine block flow requests to control coolant fluid flow in a vehicle cooling system for an internal combustion engine. A cooling system for an internal combustion engine ("engine") utilizes a flow control valve and a block rotary valve to continuously regulate the flow of coolant fluid in the vehicle cooling system through a pump. By reducing the flow of coolant fluid through the pump, it is possible to reduce the load on the engine's crankshaft, to reduce engine friction, to maximize engine combustion efficiency, and to reduce carbon dioxide emissions. Accordingly, thermal stress on the engine is reduced, preventing possible damage to or failure of the engine and its components.

By controlling the temperature of the coolant fluid, it is possible to operate the engine at the highest temperature possible without comprising the hardware integrity of the engine. This increases engine and fuel efficiency while preventing failure of the engine.

FIG. 1 depicts a vehicle engine 100 including a flow control valve (FCV) 160 and a block rotary valve (BRV) 162 that can be adjusted for combining engine head and engine block flow requests to control coolant fluid in the vehicle engine 100, according to embodiments of the present disclosure. The vehicle engine 100 includes at least a main coolant pump ("pump") 104, an engine block 110, an engine head 112, other engine components 114 (e.g., a turbocharger, an exhaust gas re-circulator, etc.), a main rotary value 130, an engine oil heat exchanger 116, a transmission oil heat exchanger 118, and a radiator 120.

The main rotary valve 130 includes a first valve (or chamber) 140 having a first inlet 141, a second inlet 142, and an outlet 143. The main rotary valve 130 also includes a second valve (or chamber) 150 having an inlet 151, a first outlet 152, and a second outlet 153. The various components of the vehicle engine 100 are connected and arranged as shown in FIG. 1 according to embodiments of the present disclosure, and the solid lines among the components represent the fluid connections among the components, with arrows representing the flow direction of the fluid.

Coolant fluid is cooled by the radiator 120 and is pumped out of the radiator 120 by the pump 104 back into the engine block 110, the engine head 112, and the other components 114 (collectively, the "inlet" of the engine). Coolant fluid cooled by the radiator 120 can also be pumped directly into the first inlet 141 of the main rotary valve 130. Managing the flow out of the radiator 120 enables mixing cold coolant with hot coolant in order to provide the coolant to the vehicle engine 100 at a desired temperature.

A valve controller 102 controls the flow of coolant fluid through the vehicle engine 100 by opening and closing (either partially or wholly) the first valve 140 and the second valve 150. In particular, the inlet temperature controller 102 can cause the second valve 150 to direct flow from the engine block 110 and the engine head 112 into the radiator 120 and/or a radiator bypass 122 through the first outlet 152 and the second outlet 153. Similarly, the valve controller 102 can cause the first valve 140 to direct flow from either the first inlet 141 and/or the second inlet 142 into the engine oil heat exchanger 116 and the transmission oil heat exchanger 118 through the outlet 143.

The first inlet 141 (also referred to as the "cold inlet") receives cooled coolant fluid via the pump 104 from the radiator 120. The second inlet 142 (also referred to as the "warm inlet") receives warm coolant fluid (warm relative to the cooled coolant fluid) after it is pumped by the pump 104 through the engine block 110/engine head 112 and the other components 114. The warm coolant fluid is warmed as it passes through the engine block 110, the engine head 112, and/or the other components. Accordingly, depending on the state of the first valve 140, the first valve 140 can provide either cooled coolant fluid or warm coolant fluid to the engine oil heat exchanger 116 and the engine transmission oil heat exchanger 118.

To reduce an influx of cool coolant fluid in the engine block 110 and the engine head 112, a flow control valve (FCV) 160 can be closed between the engine block 110/engine head 112 and the second valve 150 of the main rotary valve 130. In particular, an inlet of the FCV 160 is in fluid communication (directly and/or indirectly) with an outlet of the engine block 110 and an outlet of the engine head 112, and an outlet of the FCV 160 is in fluid communication with the inlet 151 of the second valve 150 of the main rotary valve 130 and with an inlet of other components 114.

When the FCV 160 is closed, the flow of coolant fluid into the radiator 120 is stopped so the coolant fluid is not cooled by the radiator 120. This prevents cooled coolant fluid from cycling back into the engine block 110/engine head 112. The valve controller 102 controls the FCV 160 to open and shut the FCV 160 based at least in part on state changes of the main rotary valve 130. According to some embodiments, the FCV 160 is partially closed (e.g., closed 25%, closed 50%, closed 80%, etc.) to achieve a desired flow (e.g., to maintain a consistent temperature through the vehicle engine 100).

In some situations, the engine block 110 and the engine head 112 may need different coolant fluid flow rates. For example, the engine block 110 and the engine head 112 each require a minimum flow to avoid boiling the coolant fluid and to prevent high temperatures within each block, which may cause damage thereto. Accordingly, the BRV 162 is introduced between an outlet of the engine block 110 and an inlet of the FCV 160 so that the BRV 162 is in fluid communication with the engine block 110 and the FCV 160. The BRV 162 is controllable by the valve controller 102 to flow coolant fluid through each of the engine block 110 and the engine head 112 at different rates. The valve controller 102 converts a flow request for coolant fluid flow through each of the engine block 110 and the engine head 112 to an actuator command to control the BRV 162. This ensures the correct flow of coolant fluid in each of the engine block 110 and the engine head 112 while minimizing load calculation in an engine control unit (not shown).

The valve controller 102 can continuously regulate the FCV 160 and the BRV 162 to adjust the flow of coolant fluid that the pump 104 can provide through the engine block 110 and the engine head 112. By reducing the flow of the pump 104, it is possible to also reduce the load on the crankshaft (not shown), to reduce engine friction, and to maximize combustion efficiency.

With continuing reference to FIG. 1, in embodiments of the present disclosure, the valve controller 102 can be a combination of hardware and programming. The programming may be processor executable instructions stored on a tangible memory, and the hardware can include a processing device for executing those instructions. Thus a system memory can store program instructions that when executed by the processing device implement the functionality described herein. Other engines/modules/controllers may also be utilized to include other features and functionality described in other examples herein. Alternatively or additionally, the valve controller 102 can be implemented as dedicated hardware, such as one or more integrated circuits, Application Specific Integrated Circuits (ASICs), Application Specific Special Processors (ASSPs), Field Programmable Gate Arrays (FPGAs), or any combination of the foregoing examples of dedicated hardware, for performing the techniques described herein.

Figure 2:
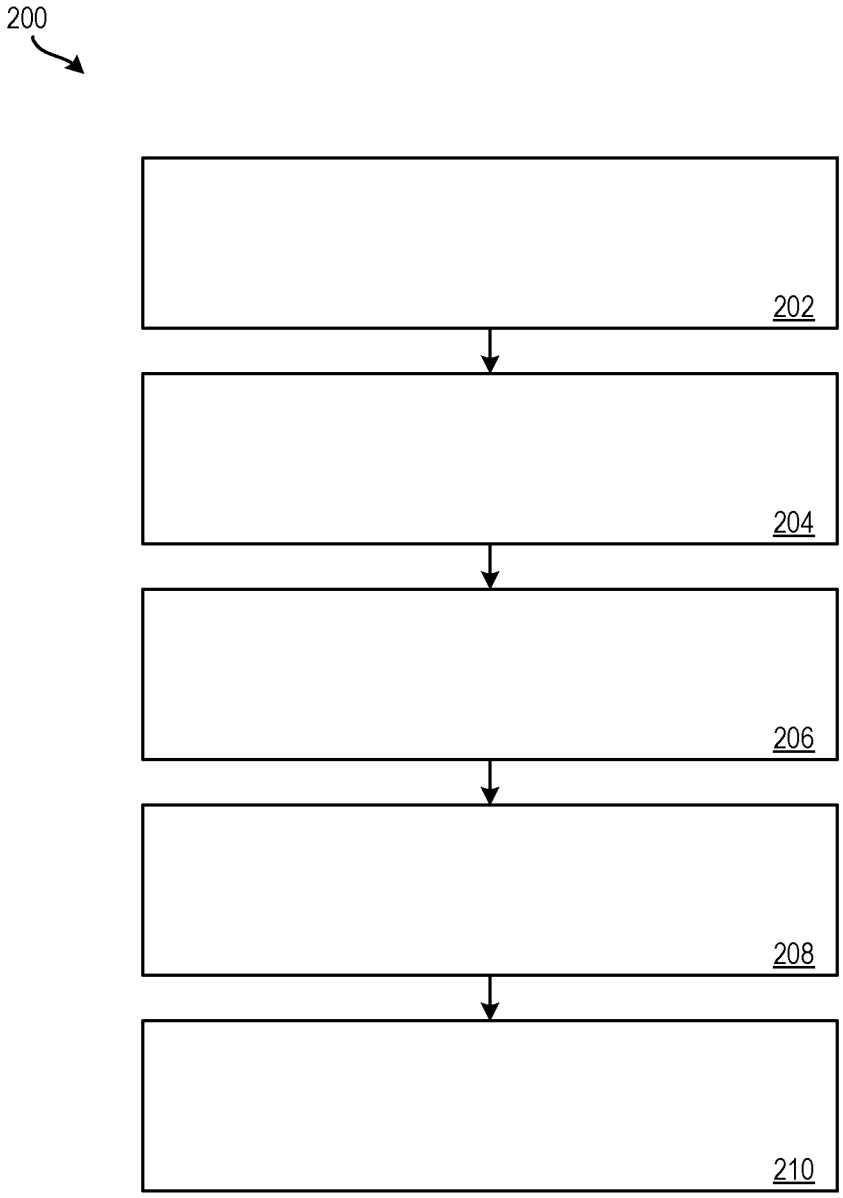
FIG. 2 depicts a flow diagram of a method for combining engine head and engine block flow requests to control coolant fluid in a vehicle cooling system, according to embodiments of the present disclosure.

FIG. 2 depicts a flow diagram of a method for combining engine head and engine block flow requests to control coolant fluid in a vehicle cooling system, according to embodiments of the present disclosure. The method 200 may be implemented, for example, by the valve controller 102 of FIG. 1, by the processing system 500 of FIG. 5 (described below), or by another suitable processing system or device.

A block 202, the valve controller 102 (i.e., a processing device or system) receives a block flow request from an engine block 110. At block 204, the valve controller 102 receives a head flow request from an engine head 112. At block 206, the valve controller 102 calculates an engine flow based at least in part on the block flow request and the head flow request. Calculating the engine flow can include summing the block flow request and the head flow request.

At block 208, the valve controller 102 calculates a flow split request based at least in part on the block flow request and the engine flow. Calculating the flow split request can include dividing the block flow request by the engine flow. At block 210, the valve controller 102 operates (e.g., opens or closes) a block rotary valve (e.g., the BRV 162) based at least in part on the block flow. This enables coolant fluid to flow through the engine head and the engine block according to the engine flow and the flow split request.

Additional processes also may be included, and it should be understood that the processes depicted in FIG. 2 represent illustrations and that other processes may be added or existing processes may be removed, modified, or rearranged without departing from the scope and spirit of the present disclosure.

Figure 3:
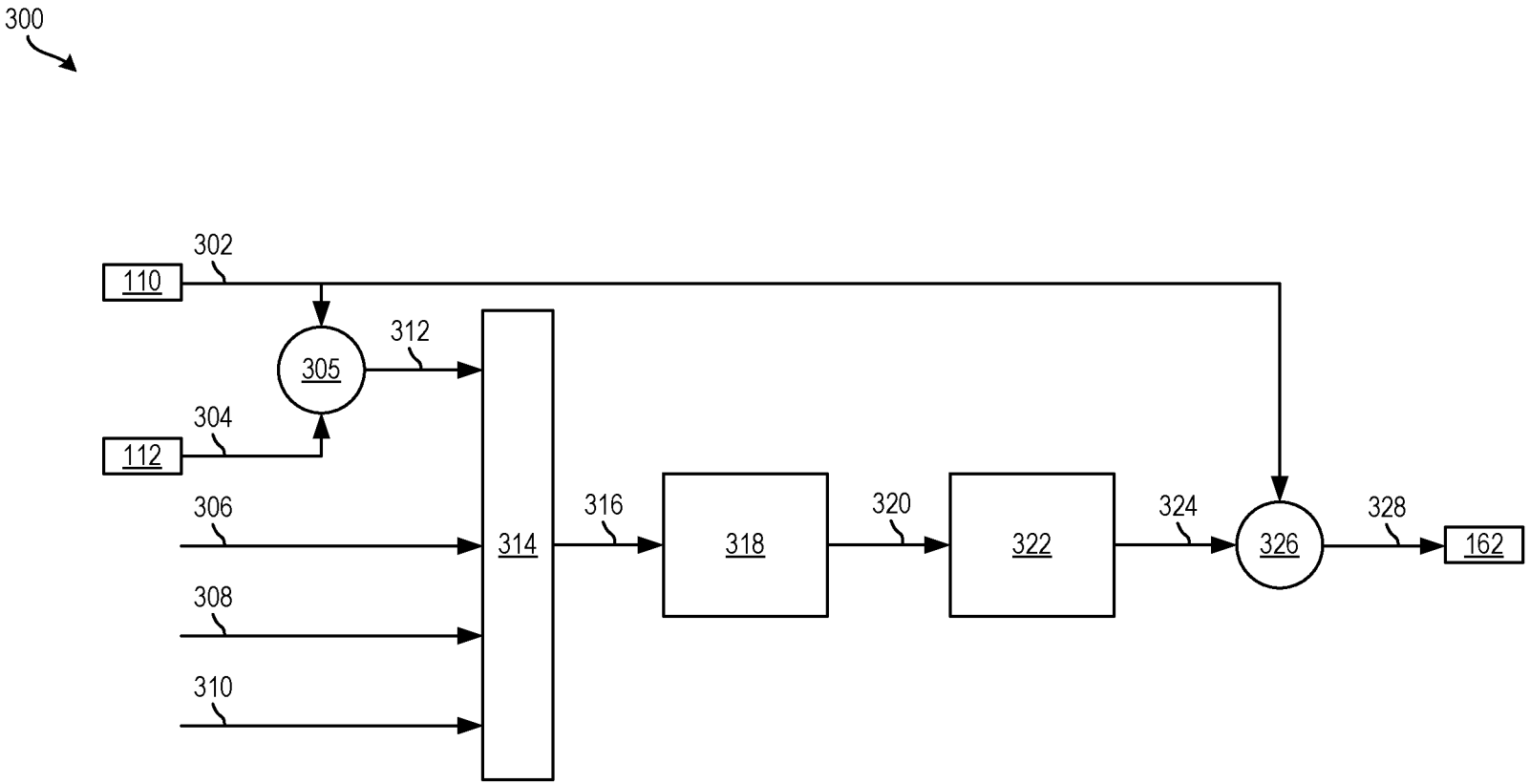
FIG. 3 depicts a flow diagram of a method for combining engine head and engine block flow requests to control coolant fluid in a vehicle cooling system, according to embodiments of the present disclosure.

FIG. 3 depicts a flow diagram of a method 300 for combining engine head and engine block flow requests to control coolant fluid in a vehicle cooling system, according to embodiments of the present disclosure. The method 300 may be implemented, for example, by the valve controller 102 of FIG. 1, by the processing system 500 of FIG. 5 (described below), or by another suitable processing system or device.

Generally, flow requests from the engine block 110 and the engine head 112 are combined to create an engine flow request. A maximum flow request (on the pump 104) is arbitrated considering other possible requestors, and the flow is converted into an FCV command to position the FCV 160 using a flow distribution model.

A block flow request 302 is received from the engine block 110 and a head flow request 304 is received from the engine head 112. An engine request 312 is calculated based on the block flow request 302 and the head flow request 304. For example, the block flow request 302 and the head flow request 304 are summed at block 305 and output as the engine request 312.

The engine request 312 along with a low-pressure cooler request 306, a turbo-compressor request 308, and/or a cabin heater request 310 are input into block 314, where it is determined which request 312, 306, 308, 310 is the maximum request. The maximum request is output as a final pump request 316 into a pump flow to FCV block 318, which converts the final pump request 316 into a final FCV request 320 to control the FCV 160.

The final FCV request 320 is input into an FCV to engine flow module 322 to convert the final FCV request 320 into an engine flow actuated value 324. The block flow request 302 is then divided by the engine flow actuated value 324 at block 326 to calculate a flow split request 328. The split request 328 represents a percentage of coolant fluid flow to be allocated to the engine block 110. The remaining coolant fluid flow is to be allocated to the engine head 112. For example, if it is calculated at block 326 to allocate 30% coolant fluid flow to the engine block 110, then 70% coolant fluid flow is allocated to the engine head 112.

The split request 328 is sent to the BRV 162. The BRV 162 is operated (e.g., partially or wholly opened or closed) to implement a flow rate corresponding to the split request 328 so that an appropriate amount of cooling fluid flows through the engine head 112 and the engine block 110.

Additional processes also may be included, and it should be understood that the processes depicted in FIG. 3 represent illustrations and that other processes may be added or existing processes may be removed, modified, or rearranged without departing from the scope and spirit of the present disclosure.

Figure 4:
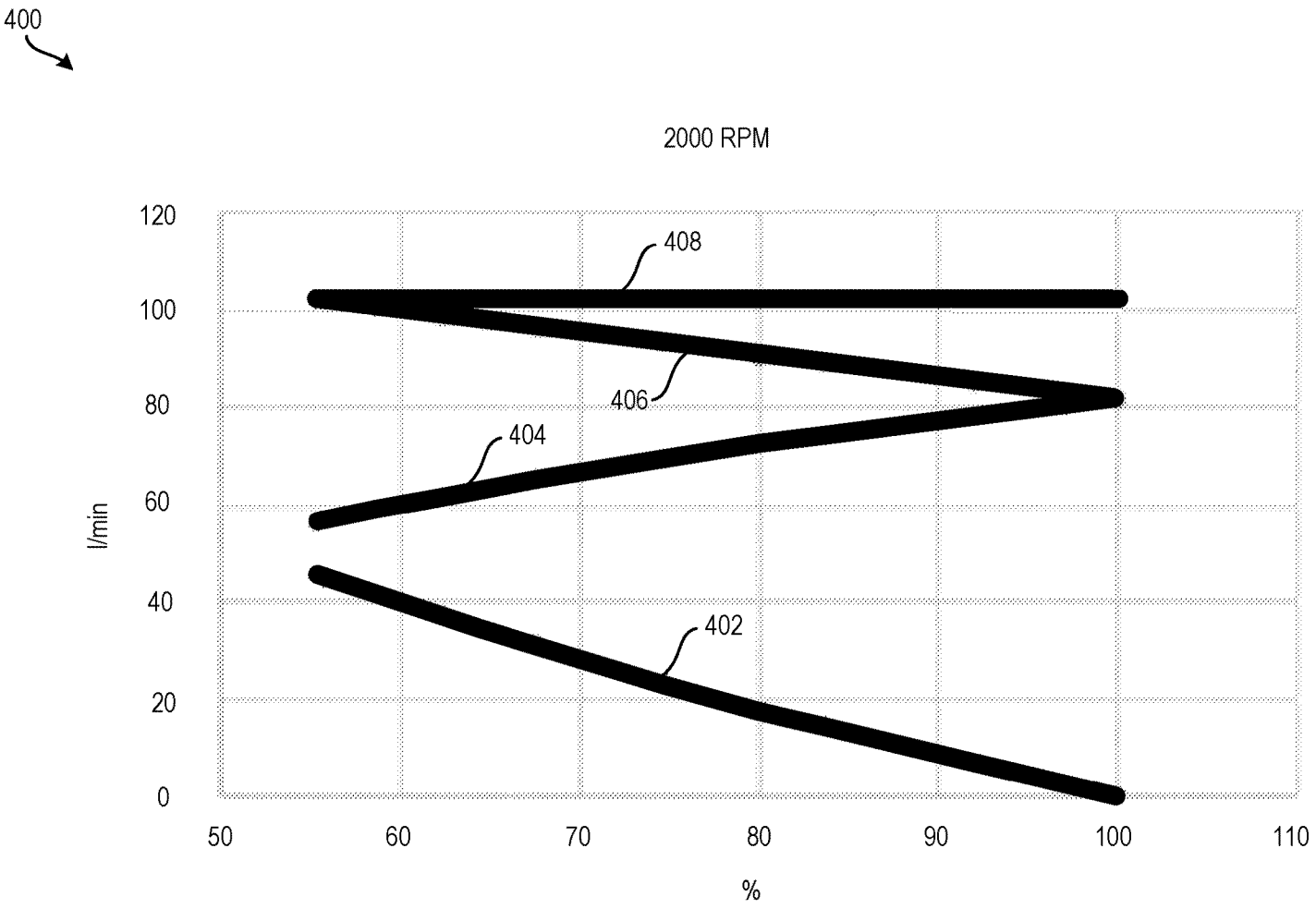
FIG. 4 depicts a graph of coolant fluid flow through the engine block and through the engine head, according to embodiments of the present disclosure.

FIG. 4 depicts a graph 400 of coolant fluid flow through the engine block 110 and through the engine head 112, according to embodiments of the present disclosure. In particular, the graph 400 plots coolant flow (vertical axis) in liters per minute (1/min) against coolant fluid flow percentage (horizontal axis) as a percent (%) for a vehicle engine (e.g., the vehicle engine 100) operating at 2000 RPM.

The line 402 represents a percentage of flow of coolant fluid through the engine block 110 and the line 404 represents a percentage of flow of coolant fluid through the engine head 112.

As discussed herein, the an engine flow is calculated based on a block flow request and a head flow request and then a flow split request is calculated based on the block flow request and the engine flow request. That is, the FCV 160 position is determined to provide the engine flow to the engine (e.g., the engine block 110 and the engine head 112) and the BRV 162 position is determined to provide the block flow to the engine block 110. This is acceptable if the BRV 162 position does not influence the total engine flow in the engine as represented by line 408. However, because the BRV 162 position does influence the total engine flow in the engine, the actual total engine flow through the engine block 110 and the engine head 112 is represented by line 406. Therefore, the present techniques provide the ability to account for simplicity with respect to software development and calibration against flow model accuracy.

Figure 5:
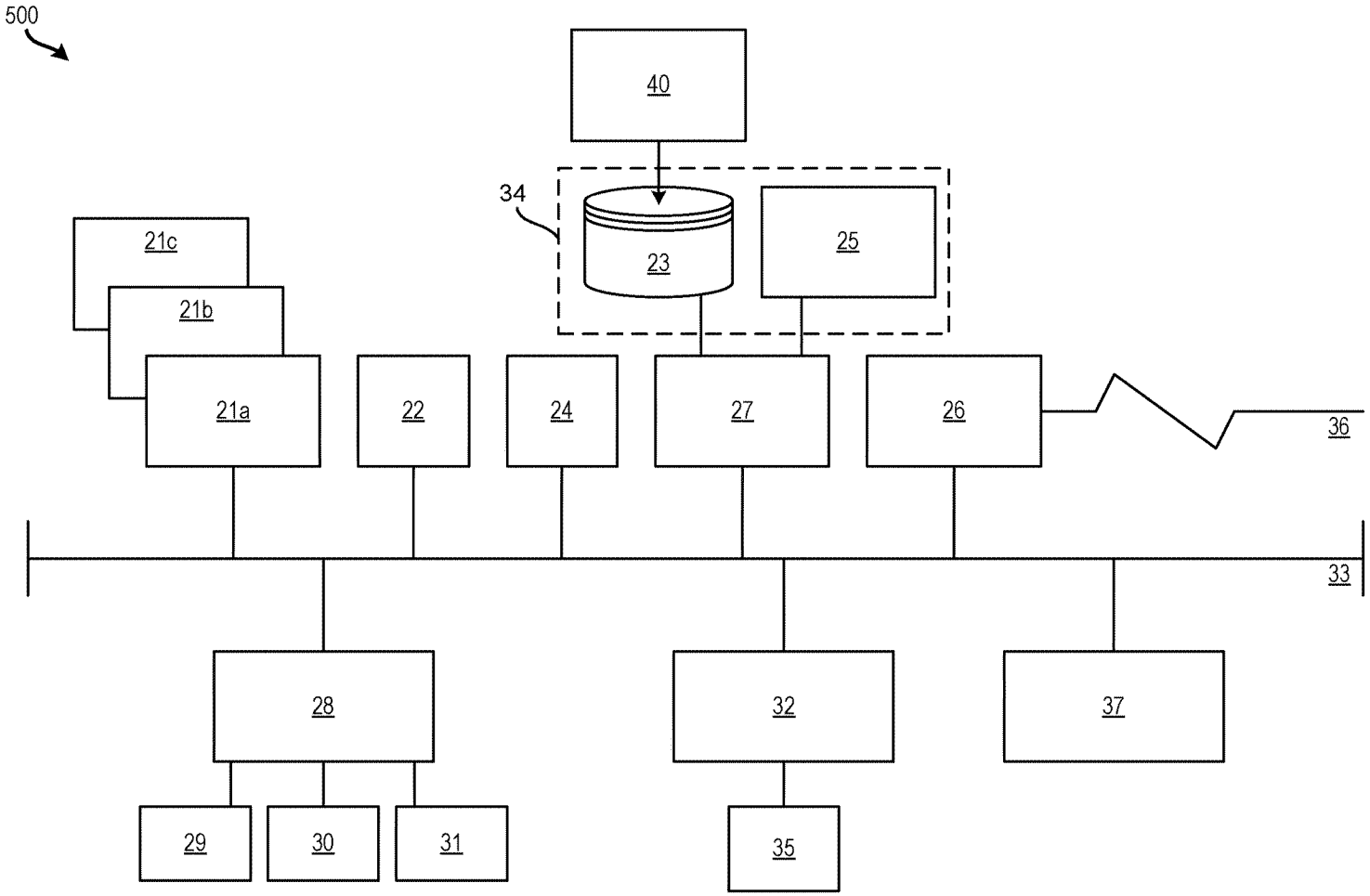
FIG. 5 depicts a block diagram of a processing system for implementing the techniques described herein, according to embodiments of the present disclosure.

It is understood that the present disclosure is capable of being implemented in conjunction with any other type of computing environment now known or later developed. For example, FIG. 5 illustrates a block diagram of a processing system 500 for implementing the techniques described herein. In examples, processing system 500 has one or more central processing units (processors) 21*a*, 21*b*, 21*c*, etc. (collectively or generically referred to as processor(s) 21 and/or as processing device(s)). In aspects of the present disclosure, each processor 21 may include a reduced instruction set computer (RISC) microprocessor. Processors 21 are coupled to system memory (e.g., random access memory (RAM) 24) and various other components via a system bus 33. Read only memory (ROM) 22 is coupled to system bus 33 and may include a basic inlet/outlet system (BIOS), which controls certain basic functions of processing system 500.

Further illustrated are an inlet/outlet (I/O) adapter 27 and a network adapter 26 coupled to system bus 33. I/O adapter 27 may be a small computer system interface (SCSI) adapter that communicates with a hard disk 23 and/or another storage drive 25 or any other similar component. I/O adapter 27, hard disk 23, and storage device 25 are collectively referred to herein as mass storage 34. Operating system 40 for execution on processing system 500 may be stored in mass storage 34. A network adapter 26 interconnects system bus 33 with an outside network 36 enabling processing system 500 to communicate with other such systems.

A display (e.g., a display monitor) 35 is connected to system bus 33 by display adapter 32, which may include a graphics adapter to improve the performance of graphics intensive applications and a video controller. In one aspect of the present disclosure, adapters 26, 27, and/or 32 may be connected to one or more I/O busses that are connected to system bus 33 via an intermediate bus bridge (not shown). Suitable I/O buses for connecting peripheral devices such as hard disk controllers, network adapters, and graphics adapters typically include common protocols, such as the Peripheral Component Interconnect (PCI). Additional inlet/outlet devices are shown as connected to system bus 33 via user interface adapter 28 and display adapter 32. A keyboard 29, mouse 30, and speaker 31 may be interconnected to system bus 33 via user interface adapter 28, which may include, for example, a Super I/O chip integrating multiple device adapters into a single integrated circuit.

In some aspects of the present disclosure, processing system 500 includes a graphics processing unit 37. Graphics processing unit 37 is a specialized electronic circuit designed to manipulate and alter memory to accelerate the creation of images in a frame buffer intended for outlet to a display. In general, graphics processing unit 37 is very efficient at manipulating computer graphics and image processing, and has a highly parallel structure that makes it more effective than general-purpose CPUs for algorithms where processing of large blocks of data is done in parallel.

Thus, as configured herein, processing system 500 includes processing capability in the form of processors 21, storage capability including system memory (e.g., RAM 24), and mass storage 34, inlet means such as keyboard 29 and mouse 30, and outlet capability including speaker 31 and display 35. In some aspects of the present disclosure, a portion of system memory (e.g., RAM 24) and mass storage 34 collectively store an operating system to coordinate the functions of the various components shown in processing system 500.

The descriptions of the various examples of the present disclosure have been presented for purposes of illustration, but are not intended to be exhaustive or limited to the embodiments disclosed. Many modifications and variations will be apparent to those of ordinary skill in the art without departing from the scope and spirit of the described techniques. The terminology used herein was chosen to best explain the principles of the present techniques, the practical application or technical improvement over technologies found in the marketplace, or to enable others of ordinary skill in the art to understand the techniques disclosed herein.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present techniques not be limited to the particular embodiments disclosed, but will include all embodiments falling within the scope of the application.

What is claimed is:

1. A computer-implemented method for combining flow requests to control coolant fluid in a cooling system for an internal combustion engine, the method comprising:

receiving, by a processing device, a block flow request, wherein the block flow request is a flow request for coolant fluid flow through an engine block;

receiving, by the processing device, a head flow request, wherein the head flow request is a flow request for coolant fluid flow through an engine head;

calculating, by the processing device, an engine flow based at least in part on the block flow request and the head flow request;

calculating, by the processing device, a flow split request based at least in part on the block flow request and the engine flow; and operating, by the processing device, a block rotary valve based at least in part on the flow split request, wherein an inlet of the block rotary valve is in fluid communication with an outlet of an engine block and an outlet of the block rotary valve is in fluid communication with a first inlet of a flow control valve, wherein an outlet of the engine head is in fluid communication with a second inlet of the flow control valve, and wherein an outlet of the flow control valve is in fluid communication with an inlet of a main rotary valve comprising a first outlet in fluid communication with a radiator bypass and a second outlet in fluid communication with a radiator.

2. The computer-implemented method of claim 1, wherein calculating the engine flow comprises summing the block flow request and the head flow request.

3. The computer-implemented method of claim 1, wherein calculating the flow split request comprises dividing the block flow request by the engine flow.

4. The computer-implemented method of claim 1, wherein operating the block rotary valve comprises one of opening the block rotary valve or closing the block rotary valve.

5. The computer-implemented method of claim 1, wherein operating the block rotary valve enables the coolant fluid to flow through the engine head and the engine block based on the engine flow and the flow split request.

6. A system for combining flow requests to control coolant fluid in a cooling system for an internal combustion engine, the system comprising:

a memory comprising computer readable instructions; and a processing device for executing the computer readable instructions for performing a method, the method comprising:

receiving, by the processing device, a block flow request, wherein the block flow request is a flow request for coolant fluid flow through an engine block;

receiving, by the processing device, a head flow request, wherein the head flow request is a flow request for coolant fluid flow through an engine head;

calculating, by the processing device, an engine flow based at least in part on the block flow request and the head flow request;

calculating, by the processing device, a flow split request based at least in part on the block flow request and the engine flow; and operating, by the processing device, a block rotary valve based at least in part on the flow split request, wherein an inlet of the block rotary valve is in fluid communication with an outlet of an engine block and an outlet of the block rotary valve is in fluid communication with a first inlet of a flow control valve, wherein an outlet of the engine head is in fluid communication with a second inlet of the flow control valve, and wherein an outlet of the flow control valve is in fluid communication with an inlet of a main rotary valve comprising a first outlet in fluid communication with a radiator bypass and a second outlet in fluid communication with a radiator.

7. The system of claim 6, wherein calculating the engine flow comprises summing the block flow request and the head flow request.

8. The system of claim 6, wherein calculating the flow split request comprises dividing the block flow request by the engine flow.

9. The system of claim 6, wherein operating the block rotary valve comprises one of opening the block rotary valve or closing the block rotary valve.

10. The system of claim 6, wherein operating the block rotary valve enables the coolant fluid to flow through the engine head and the engine block based on the engine flow and the flow split request.

11. A computer program product for combining flow requests to control coolant fluid in a cooling system for an internal combustion engine, the computer program product comprising:

a computer readable storage medium having program instructions embodied therewith, wherein the computer readable storage medium is not a transitory signal per se, the program instructions executable by a processing device to cause the processing device to perform a method comprising:

receiving, by the processing device, a block flow request, wherein the block flow request is a flow request for coolant fluid flow through an engine block;

receiving, by the processing device, a head flow request, wherein the head flow request is a flow request for coolant fluid flow through an engine head;

calculating, by the processing device, an engine flow based at least in part on the block flow request and the head flow request;

calculating, by the processing device, a flow split request based at least in part on the block flow request and the engine flow; and operating, by the processing device, a block rotary valve based at least in part on the flow split request, wherein an inlet of the block rotary valve is in fluid communication with an outlet of an engine block and an outlet of the block rotary valve is in fluid communication with a first inlet of a flow control valve, wherein an outlet of the engine head is in fluid communication with a second inlet of the flow control valve, and wherein an outlet of the flow control valve is in fluid communication with an inlet of a main rotary valve comprising a first outlet in fluid communication with a radiator bypass and a second outlet in fluid communication with a radiator.

12. The computer program product of claim 11, wherein calculating the engine flow comprises summing the block flow request and the head flow request.

13. The computer program product of claim 11, wherein calculating the flow split request comprises dividing the block flow request by the engine flow.

14. The computer program product of claim 11, operating the block rotary valve comprises one of opening the block rotary valve or closing the block rotary valve.

15. The computer program product of claim 11, wherein operating the block rotary valve enables the coolant fluid to flow through the engine head and the engine block based on the engine flow and the flow split request.

* * * * *